US009479872B2

(12) United States Patent
Tachibana et al.

(10) Patent No.: US 9,479,872 B2
(45) Date of Patent: Oct. 25, 2016

(54) AUDIO REPRODUCING METHOD AND APPARATUS

(71) Applicant: Sony Mobile Communications, Inc., Tokyo (JP)

(72) Inventors: Makoto Tachibana, Tokyo (JP); Takashi Shiina, Kanagawa (JP); Tetsuya Naruse, Kanagawa (JP); Yuichi Shirai, Tokyo (JP); Chikashi Yajima, Kanagawa (JP); Susumu Takatsuka, Tokyo (JP)

(73) Assignees: Sony Corporation, Tokyo (JP); Sony Mobile Communications, Inc., Tokyo (JP)

( * ) Notice: Subject to any disclaimer, the term of this patent is extended or adjusted under 35 U.S.C. 154(b) by 275 days.

(21) Appl. No.: 14/022,736

(22) Filed: Sep. 10, 2013

(65) Prior Publication Data

US 2014/0072154 A1 Mar. 13, 2014

Related U.S. Application Data

(60) Provisional application No. 61/698,899, filed on Sep. 10, 2012.

(51) Int. Cl.

| | |
|---|---|
| ***H04R 5/033*** | (2006.01) |
| *H04R 1/10* | (2006.01) |
| *H04R 5/027* | (2006.01) |

(52) U.S. Cl.

CPC ..... *H04R 5/033* (2013.01); *H04R 1/1041* (2013.01); *H04R 5/027* (2013.01); *H04R 2420/01* (2013.01); *H04R 2420/07* (2013.01); *H04R 2420/09* (2013.01)

(58) Field of Classification Search

CPC ..... H04R 5/033; H04R 2420/01; H04R 2420/09; H04R 5/027; H04R 2420/07; H04R 1/1041

USPC ..... 381/2, 74, 23.1, 309, 369; 700/94

See application file for complete search history.

(56) References Cited

U.S. PATENT DOCUMENTS

| | | | | |
|---|---|---|---|---|
| 7,346,172 | B1 * | 3/2008 | Begault | 381/56 |
| 8,150,044 | B2 * | 4/2012 | Goldstein | H04R 25/453 381/317 |
| 9,191,744 | B2 * | 11/2015 | Anderson | H04R 5/04 |
| 2006/0083388 | A1 * | 4/2006 | Rothschild | H04H 60/04 381/81 |
| 2008/0181419 | A1 * | 7/2008 | Goldstein et al. | 381/57 |
| 2012/0215519 | A1 * | 8/2012 | Park | G06F 17/289 704/2 |

FOREIGN PATENT DOCUMENTS

| | | |
|---|---|---|
| JP | 2002-005675 | 1/2002 |

* cited by examiner

*Primary Examiner* — Davetta W Goins
*Assistant Examiner* — Oyesola C Ojo
(74) *Attorney, Agent, or Firm* — Oblon, McClelland, Maier & Neustadt, L.L.P.

(57) ABSTRACT

An information processing apparatus that reproduces left and right audio signals based on data acquired from a sound source; acquires left and right surrounding sounds collected by left and right microphones included in a headphone unit connected to the information processing apparatus; combines a sound corresponding to at least one of the left and right surrounding sounds with at least one of the left and right audio signals; and outputs the left and right audio signals combined with the sound corresponding to the at least one of the left and right surrounding sounds to left and right earphones of the headphone unit.

8 Claims, 11 Drawing Sheets

AUDIO REPRODUCING METHOD AND APPARATUS

CROSS REFERENCE TO RELATED APPLICATION

The present application claims the benefit of the earlier filing date of U.S. Provisional Patent Application Ser. No. 61/698,899 filed on Sep. 10, 2012, the entire contents of which is incorporated herein by reference.

BACKGROUND

1. Field of the Disclosure

The present disclosure relates to an audio reproducing method and apparatus with which audio reproduction is performed through the use of stereo headphones including left and right microphones.

2. Description of Related Art

Headphones are provided as a device that converts an audio signal output from an audio reproducing apparatus into a sound wave (audible sound), and allows a user to listen to a sound, a music, etc. basically privately. As the audio reproducing apparatus, various apparatuses including a mobile phone terminal, a music player, a video player, a television set, a radio receiver, an electronic dictionary, a game machine, etc. are available. Hereinafter, a portable mobile terminal that can be carried by a user will be described as an example of the audio reproducing apparatus.

Headphones are broadly divided into those with a headband and those without a headband. As the headphones without a headband, headphones of various types including an inner-ear type or a canal type, an ear-hang type, etc. are commercially available. With increased performance, headphones of each type are so configured that a reproduced sound does not leak to the surroundings in the state of being worn by a user. Wearing such headphones for the above-described various types of audio reproducing apparatuses allows the user to enjoy an audio application without causing inconvenience to those around the user.

SUMMARY

In relation to route guidance for a pedestrian, an audio navigation apparatus performing guidance by voice, which is described in Japanese Unexamined Patent Application Publication No. 2002-5675, has been proposed.

However, the above-described headphones with increased performance may function to block surrounding sounds for a user wearing the headphones. Therefore, the surrounding sounds hardly reach the user. As a result, the harmful effects of being unaware of the approach of a vehicle, etc. may occur when a user uses the audio navigation apparatus, or listens to music while walking on a road.

In this context, the inventor of the present application recognizes the necessity to make a user enjoying the benefit of an audio application through the use of headphones aware of, for example, the approach of a dangerous object such as a vehicle by means of a surrounding sound.

According to one exemplary embodiment, the present disclosure is directed to an information processing apparatus that reproduces left and right audio signals based on data acquired from a sound source; acquires left and right surrounding sounds collected by left and right microphones included in a headphone unit connected to the information processing apparatus; combines a sound corresponding to at least one of the left and right surrounding sounds with at least one of the left and right audio signals; and outputs the left and right audio signals combined with the sound corresponding to the at least one of the left and right surrounding sounds to left and right earphones of the headphone unit.

DETAILED DESCRIPTION

Hereinafter, embodiments of the present disclosure will be described in detail with reference to drawings.

First, the configurations of headphones and mobile terminals to which the headphones are connected, which are used in the present embodiment, will be described.

Figure 1A:
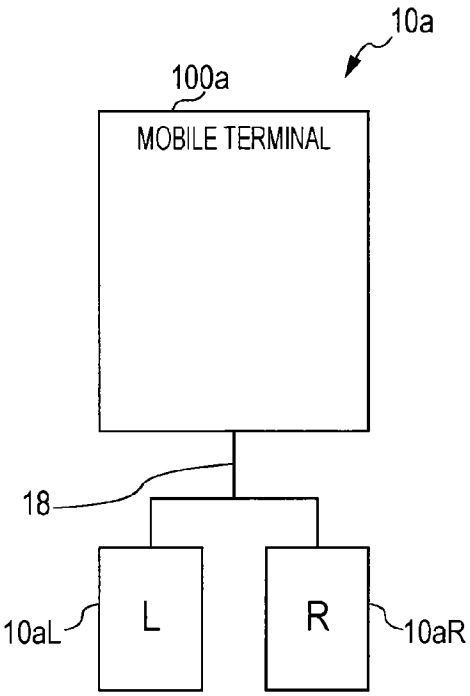
FIGS. 1A, 1B, and 1C are diagrams illustrating schematic configurations of mobile terminals having stereo headphones for wired connection or wireless connection.
Figure 1B:
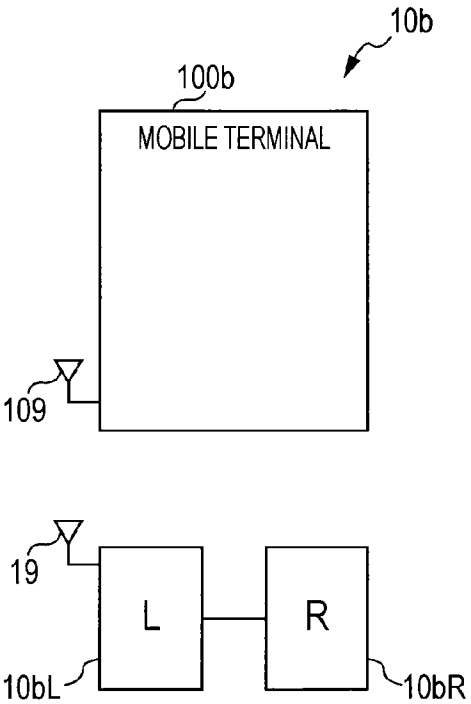
Figure 1C:
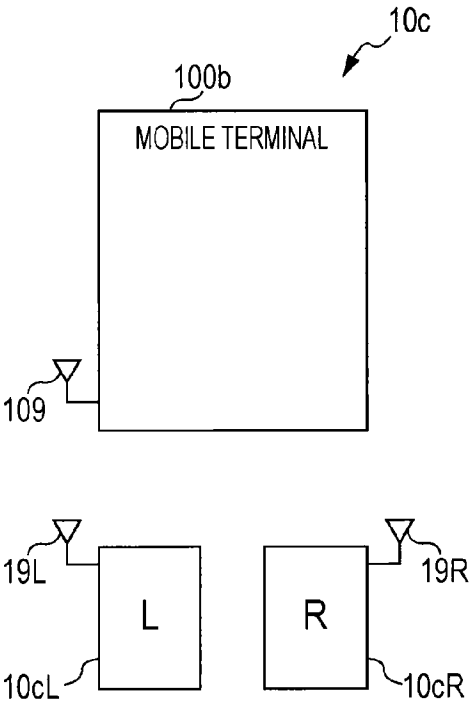

FIGS. 1A, 1B, and 1C illustrate schematic configurations of mobile terminals 100*a* and 100*b* with stereo headphones for wired connection or wireless connection. Left and right earphones 10*a*L and 10*a*R of headphones 10*a* for wired connection are connected to the corresponding mobile terminal 100*a* via a cable 18.

Left and right earphones 10*b*L and 10*b*R of headphones 10*b* for wireless connection are wirelessly connected to the mobile terminal 100*b* via an antenna 19 of the headphones 10*b* and an antenna 109 of the corresponding mobile terminal 100*b*. When the earphones 10*b*L and 10*b*R are coupled through, for example, a headband which will be described later, the earphones 10*b*L and 10*b*R can share the single antenna 19 (and a communication circuit) as illustrated in FIG. 1B. When left and right earphones 10*c*L and 10*c*R are separated from (independent of) each other as is the case with headphones 10*c* for wireless connection, which is illustrated in FIG. 1C, both of the earphones have individual antennas 19L and 19R (and communication circuits). According to the stereo headphones of the present embodiment, either of the left and right earphones has a microphone (also simply referred to as a mike). Earphones with such mikes are also referred to as a headset.

Figure 2A:
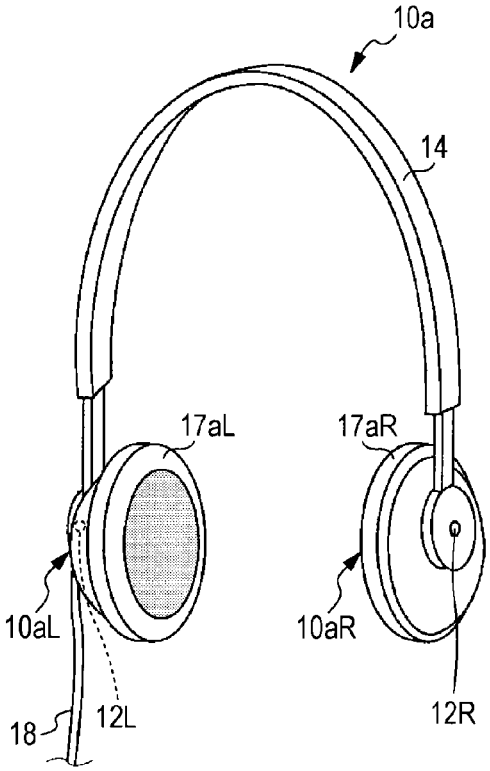
FIGS. 2A and 2B are diagrams illustrating exemplary external views of headphones for wired connection and wireless connection, respectively.
Figure 2B:
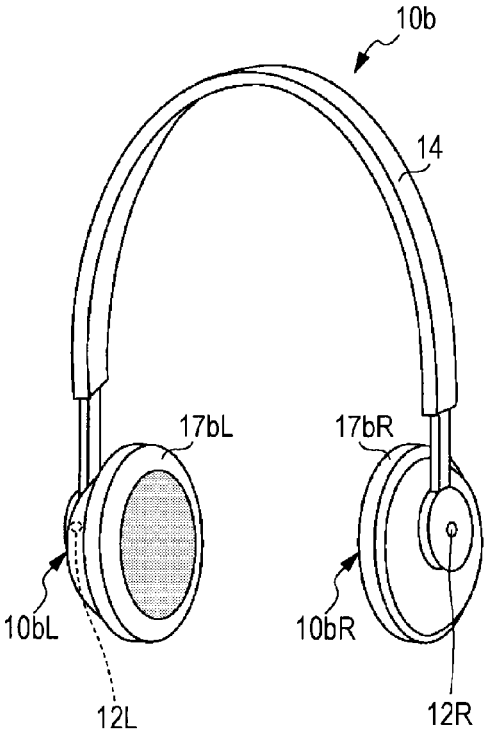

In FIGS. 2A and 2B, exemplary external views of the headphones 10*a* and 10*b* for wired connection and wireless connection are respectively illustrated.

According to the headphones 10*a* for wired connection, which is illustrated in FIG. 2A, the left and right earphones 10*a*L and 10*a*R are coupled through a headband 14. For the left and right earphones 10*a*L and 10*a*R, ear-pad parts 17*a*L and 17*a*R thereof include microphones 12L and 12R. Further, a cable 18 provided to achieve wired connection is drawn out from one of the earphones (the earphone 10*a*L in this example). In the headband 14, a wire (not shown) provided to transfer signals between the earphone 10*a*L and the other earphone (the right earphone 10*a*R) passes through the inside.

According to the headphones 10*b* for wireless connection, which is illustrated in FIG. 2B, the left and right earphones 10*b*L and 10*b*R are coupled through the headband 14 as is the case with the headphones 10*a*. For the left and right earphones 10*b*L and 10*b*R, ear-pad parts 17*b*L and 17*b*R thereof include the microphones 12L and 12R. In contrast to the headphones 10*a*, the earphone 10*b*L has a radio communication part (which will be described later).

Hereinafter, headphones and earphones in which wired connection or wireless connection is not concerned will be referred to as headphones 10, and earphones 10L and 10R, respectively. The headphones are not limited to those having the headband 14. Even if no headband is used, as is the case with headphones of an inner-ear type, a canal type, or an ear-hang type, headphones with left and right mikes serve the purpose. The mikes may be provided in ear-pad parts, earphone cabinets, and so forth, but may also be provided so as to protrude therefrom, or provided at midpoints of a cable.

Figure 3:
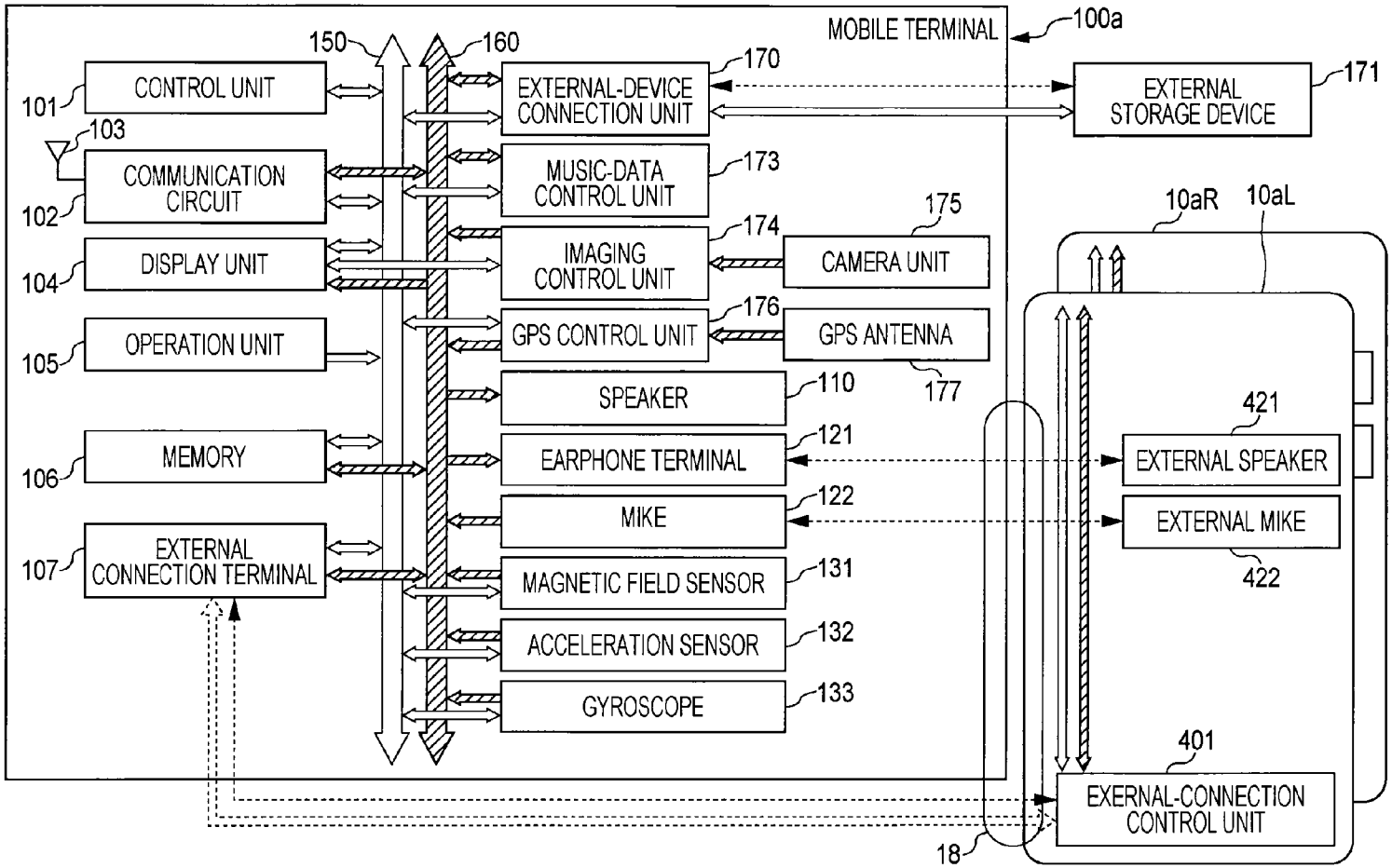
FIG. 3 is a block diagram illustrating an exemplary configuration of a mobile terminal constituting an audio reproducing apparatus according to an embodiment of the present disclosure.

FIG. 3 is a block diagram illustrating an exemplary configuration of the mobile terminal 100*a* constituting an audio reproducing apparatus according to the present embodiment. The mobile terminal 100*a* includes the wired-connection stereo earphones 10*a*L and 10*a*R.

The mobile terminal 100*a* has a control line 150 and a data line 160, and includes the following function units of various types, which are connected to those lines.

The control unit 101 is constituted by a processing unit including a CPU (Central Processing Unit), etc., and performs the execution of various control programs or application programs, and various data processing operations, which is associated therewith. In the data processing operations, for example, communication control, audio processing control, and image processing control are performed. Further, processing of various signals, control of each unit, etc. are performed.

A communication circuit 102 is a radio-communication circuit to be used when the mobile terminal 100 communicates with a radio base station of a mobile phone network. An antenna 103 is a radio communication antenna to be used when the mobile terminal radio-communicates with the radio base station.

A display unit 104 is a part responsible for the control of the display interface of the mobile terminal, and includes a display device such as a liquid crystal display unit (LCD: Liquid Crystal Display), and an organic EL display unit (OEL: Organic Electro Luminescence). The display unit 104 may further include a light emitting unit such as an LED (light emitting diode).

An operation unit 105 is a part responsible for the control of an input interface provided for a user, and has plural operation keys and/or a touch panel.

A memory 106 is an internal storage device including, for example, a RAM, a flash memory, etc. The flash memory is a nonvolatile memory, and is used to store, for example, the program of an OS (Operating System), a control program enabling the control unit 101 to control each unit, various application programs, compressed and encoded track, video, and still-image data content, and various set values, font data, data of dictionaries, model-name information, terminal identification information, etc. Further, the flash memory may store a phone book where the phone number, the electronic mail address, the address, the name, the face photo, etc. of a user are registered, and store transmitted/received electronic mails, a schedule book where the schedule of the user of the mobile terminal is registered, and so forth. A RAM stores data if necessary, as a work area to be used when the control unit 101 performs various data processing operations or computations.

An external connection terminal 107 is a connector to which the cable 18 leading to the headphones 10*a* is connected.

An external-device connection unit 170 is a part controlling the reading and writing to be performed by an external storage device 171 which is removably attached to the mobile terminal 100*a*. The external storage device 171 is, for example, an external memory card including what is referred to as an SD (Secure Digital) card, etc. In that case, the external-device connection unit 170 includes a slot into which a memory card is inserted or from which a memory card is removed, and performs control on writing/reading of data to/from the inserted memory card, etc. and signal processing.

A music-data control unit 173 is a part performing read and reproduction processing for music data stored in the external storage device 171 and the memory 106. The part may perform write processing for music data. Reproduced music data may be converted into a sound for listening through the headphones 10*a*.

An imaging control unit 174 performs imaging control for an integrated camera unit 175.

A GPS control unit 176 functions as a position detector provided to receive a signal transmitted from a certain satellite through a GPS antenna 177, and acquire the position information (at least the latitude and longitude information) of the present position.

A speaker 110 is an electroacoustic transducer which transduces an electric signal into a voice and outputs a reception voice. A microphone unit (mike) 122 is a device provided to output a transmission voice, which transduces a voice into an electrical signal.

When the headphones 10*a* are connected to the mobile terminal 100*a*, an external speaker 421 and an external mike 422 that are provided in the headphones 10*a* are used in place of the speaker 110 and the mike 122 that are integrated into the terminal. To an earphone terminal 121, the external speaker 421 of the headphones 10*a* is connected via the cable 18.

A magnetic field sensor 131, an acceleration sensor 132, and a gyroscope 133 are provided to detect the attitude, the moving speed, etc. of the mobile terminal 100*a*.

The earphones 10*a*L and 10*a*R respectively include the external speaker 421 and the external mike 422. The earphones 10*a*L and 10*a*R are connected with a wire to each other. The earphone 10*a*L has an external-connection control unit 401 and connects with a wire the earphones 10*a*L and

10*a*R to the mobile terminal 100*a*. The external-connection control unit 401 includes, more specifically, connectors of USB2.0 (Universal Serial Bus 2.0) standard, for example, as various external connectors. Accordingly, the mobile terminal also includes a USB2.0 controller.

Further, elements that are not directly used in the present embodiment are also illustrated in the mobile terminal 100*a*. The mobile terminal 100*a* may include other components that are not illustrated and that are provided in an existing mobile terminal.

Figure 4:
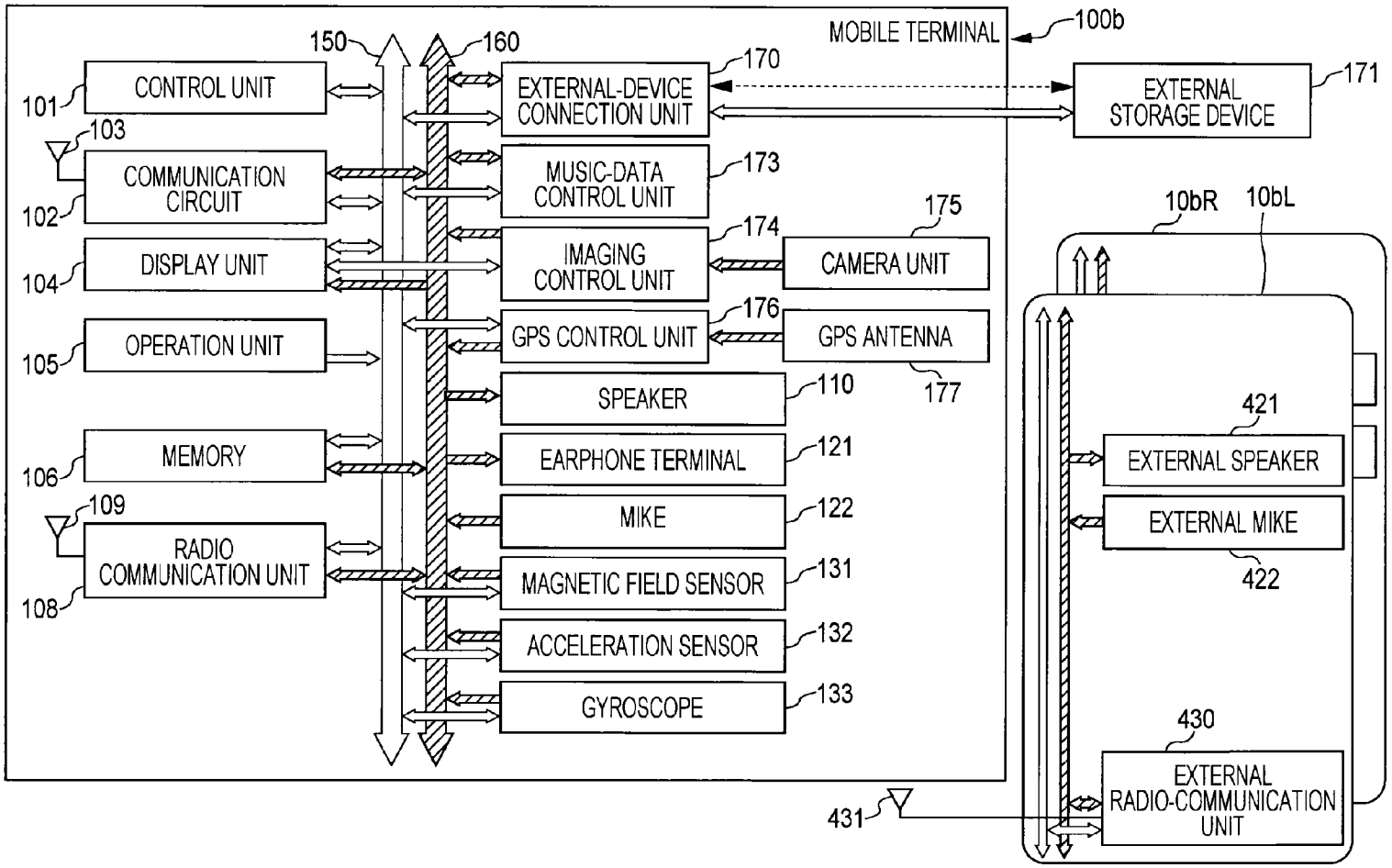
FIG. 4 is a diagram illustrating an exemplary configuration of a mobile terminal using wireless-connection type headphones.

FIG. 4 illustrates an exemplary configuration of the mobile terminal 100*b* using the wireless-connection type headphones 10*b*. Basically, the exemplary configuration is the same as the configuration of the mobile terminal 100*a* illustrated in FIG. 3 and the same elements are designated by the same reference numerals and redundant descriptions are omitted. Only different points will be described.

The headphones 10*b* include an external radio-communication unit 430 and an external communication antenna 431, and perform radio communications with the antenna 109 of a radio communication unit 108 of the mobile terminal 100*b*. The radio communications are short range communications, and relatively short-distance radio communications are performed in a short range communication mode, for example, Bluetooth (registered trademark) and the like.

Next, a specific example of an application achieved through the use of the mobile terminal 100 (generally referring to 100*a* and 100*b*) and the stereo headphones 10 (generally referring to 10*a*, 10*b*, and 10*c*) having the above-described configurations will be described.

Figure 5:
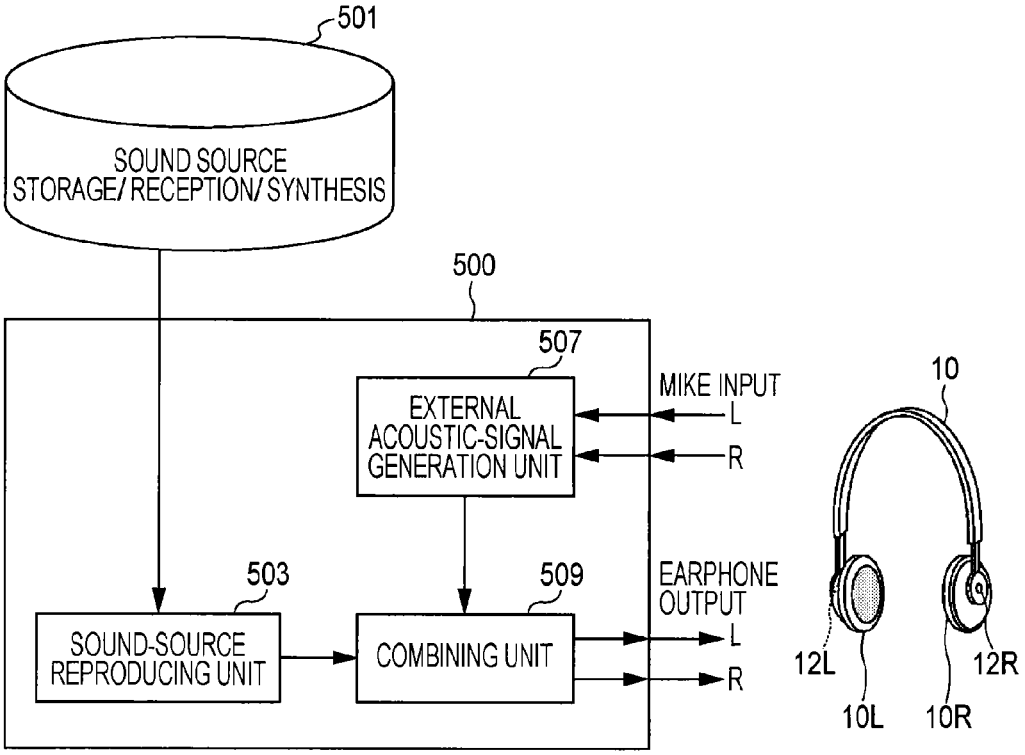
FIG. 5 is a diagram illustrating a schematic configuration of an audio reproducing apparatus according to a first embodiment of the present disclosure.

FIG. 5 illustrates a schematic configuration of an audio reproducing apparatus according to a first embodiment of the present disclosure. The headphones 10 having the left and right microphones and the left and right earphones are attached to an audio reproducing apparatus 500. The headphones 10 may be connected with a wire or may be wirelessly connected.

The audio reproducing apparatus 500 has the same hardware configuration as that of the mobile terminal illustrated in FIG. 3 or FIG. 4, and has a sound source 501, a sound-source reproducing unit 503, and an external audio-signal generation unit 507, and a combining unit 509 as functions thereof.

The sound source 501 is provided as a unit storing track data reproduced with a music player, a voice data provided for an audio navigation apparatus, etc., and is provided as an internal memory, a removable external memory, etc. of the audio reproducing apparatus 500. Otherwise, the sound source 501 may be provided in, for example, a server accessed via an external network. Furthermore, the sound source 501 may be provided as a synthesis unit generating voice data acquired by synthesizing a voice based on text data, etc.

The sound-source reproducing unit 503 is a part reproducing left and right audio signals based on data acquired from the sound source 501.

The external audio-signal generation unit 507 is a part that receives input signals from the left and right microphones 12L and 12R that are provided in the headphones 10, and that generates left and right external audio signals that are used to replicate surrounding sounds with the left and right earphones of the headphones 10, which may include an amplifier, etc. Basically, signals that are input from the left and right mikes are respectively amplified and output to the combining unit 509 as left and right audio signals.

The combining unit 509 combines audio signals representing left and right surrounding sounds that are collected by the left and right mikes with left and right audio signals that are reproduced with the sound-source reproducing unit 503. The combined left and right audio signals are output to the left and right earphones of the headphones 10.

Figure 6A:
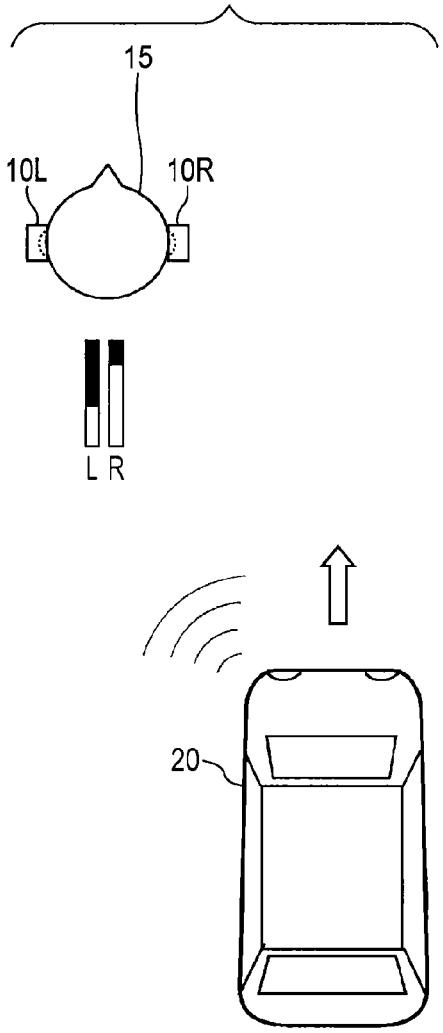
FIGS. 6A and 6B are diagrams illustrating typical usage statuses of headphones according to the present embodiment.
Figure 6B:
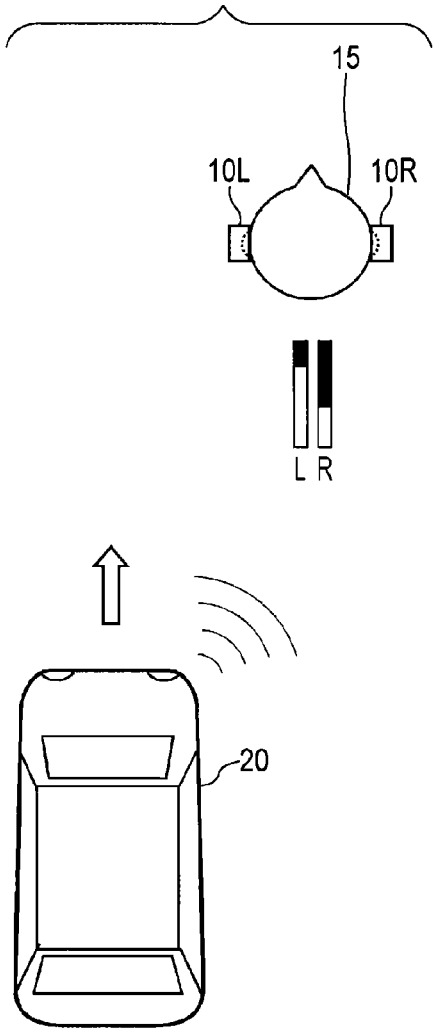

FIGS. 6A and 6B represent typical usage statuses of headphones according to the present embodiment. The headphones include left and right earphones 10L and 10R. The headphones according to the present embodiment are used not only to provide audio signals from the sound source to a user wearing those, but also to notify the user of the approach of a dangerous object such as a vehicle 20.

FIG. 6A illustrates the state where the vehicle 20 approaches from right rear of the user walking on a road. At that time, surrounding sounds that are collected by the left and right mikes of the headphones include an engine sound or a claxon sound (if any) emitted from the vehicle. In that case, the volume of a sound collected with the right-side mike is higher than that of a sound collected with the left-side mike. Consequently, the balance between the volumes of the left and right mikes is automatically reflected in volumes that are output to the left and right earphones 10L and 10R without performing particular control.

FIG. 6B illustrates the state where the vehicle 20 approaches from left rear of the user walking on a road. At that time, surrounding sounds that are collected by the left and right mikes of the headphones include an engine sound or a claxon sound (if any) emitted from the vehicle. In that case, the volume of a sound collected with the left-side mike is higher than that of a sound collected with the right-side mike. The balance between the volumes of the left and right mikes is automatically reflected in volumes that are output to the left and right earphones 10L and 10R without performing particular control.

Figure 7:
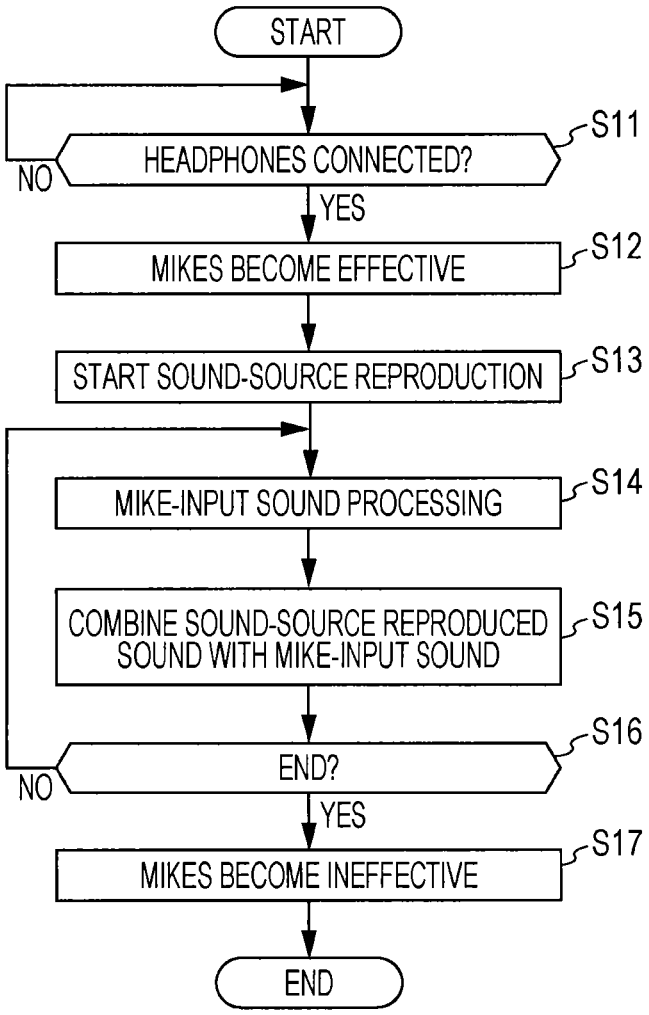
FIG. 7 is a flowchart illustrating a schematic procedure of audio reproducing processing performed in an audio reproducing apparatus.

FIG. 7 is a flowchart illustrating a schematic procedure of audio reproducing processing performed in the audio reproducing apparatus 500. The processing is achieved when the control unit 101 of the mobile terminal executes a certain application.

First, it is confirmed whether or not the headphones are connected to the audio reproducing apparatus 500 (S11). When a wired connection is established, the confirmation of a connection status can be performed by confirming whether or not the headphones are connected to the external connection terminal 107 in FIG. 3. Further, when a wireless connection is established and Bluetooth (registered trademark) is selected, for example, the connection-status confirmation can be performed by confirming whether or not devices for connection (the mobile terminal and the headphones) are effectively paired, even though the connection-state confirmation may be made differently depending on the wireless-connection mode.

After confirming the connection of the headphones, the mikes are made effective (S12). Next, reproduction of the sound source is started (S13). The start of the sound-source reproduction, which is described here, corresponds to the start of usage of a music player or the start of usage of an audio navigation device, and it is not necessary to continuously output sounds from the sound source.

After that, the collection of surrounding sounds from the left and right mikes is started and certain processing is performed (S14). The processing may include amplification and necessary filtering including noise cancellation, etc., and so forth. When performing digital processing, the processing includes analog-to-digital conversion performed for a mike-input signal and post-processing digital-to-analog conversion.

Next, the processed mike-input sound is combined with a sound-source reproduced sound (S15).

Until the end of the processing instruction is issued (S16) in accordance with an instruction from the user or control of the control unit, the processing returns to step S14 and the processing of steps S14 and S15 is repeatedly performed.

After the end instruction is issued, the mikes are made ineffective (S17), and the processing is ended.

Next, a second embodiment of the present disclosure will be described.

Figure 8:
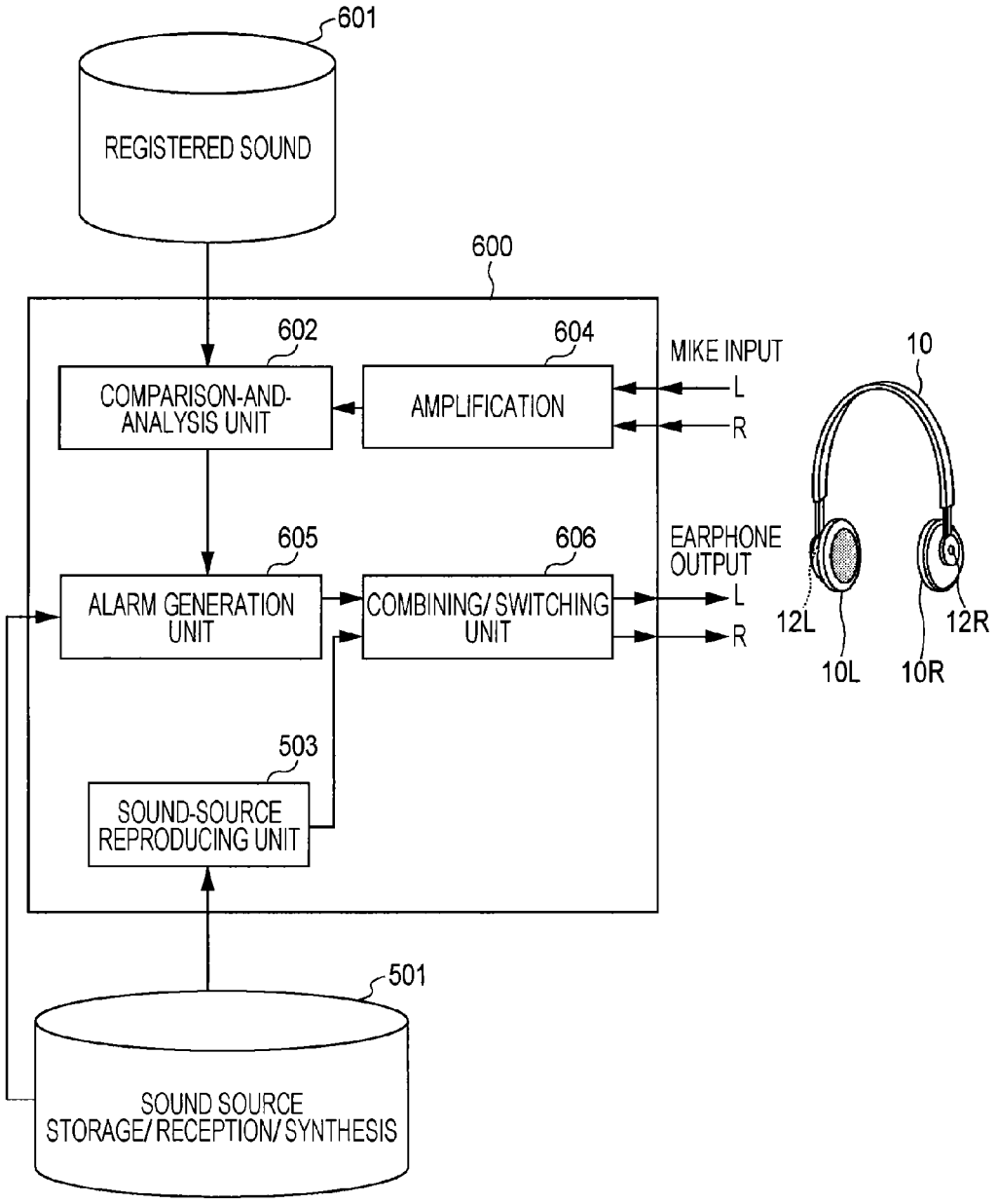
FIG. 8 is a diagram illustrating a schematic configuration of an audio reproducing apparatus according to a second embodiment of the present disclosure.

FIG. 8 illustrates a schematic configuration of an audio reproducing apparatus 600 according to the second embodiment. To the audio reproducing apparatus 600, the headphones 10 having the left and right microphones and the left and right earphones are attached. The headphones 10 may be connected with a wire or may be wirelessly connected.

The audio reproducing apparatus 600 has a similar hardware configuration to those of the mobile terminals that are illustrated in FIGS. 3 and 4, and has the sound source 501, the sound-source reproducing unit 503, a registered-sound storage unit 601, a comparison-and-analysis unit 602, an amplifying unit 604, an alarm generation unit 605, and a combining/switching unit 606 as its functions.

The sound source 501 and the sound-source reproducing unit 503 are similar to those described for the above-stated audio reproducing apparatus 500.

The registered-sound storage unit 601 is a part provided to previously store a sound which may lead to the determination that an alarm should be issued to the user when the sound occurs near the user. The registered sound is a sound emitted from a dangerous object, such as the engine sound of a vehicle, the sound of a claxon, etc. There may be plural kinds of registered sounds for registration.

The comparison-and-analysis unit 602 is a part provided to perform comparison and analysis for left and right surrounding sounds that are collected with the left and right mikes, and a previously prepared registered sound, and determine whether or not at least one of the left and right surrounding sounds includes a sound matching the registered sound. As the method of performing the comparison and analysis for the surrounding sounds and the registered sound, existing pattern matching, etc. may be used. Before performing the comparison and analysis, pre-processing may be performed to cancel noises other than the registered sound from the collected surrounding sounds.

The determination of whether or not the sound matching the registered sound is included may include a threshold-value determination. That is, the sound matching the registered sound may be a sound at a predetermined volume level or more. When such a sound is detected, a comparison-and-analysis output to be used to generate an alarm is generated. The threshold-value determination is adaptable to cases where the registered sound is detected and its occurrence location is far, which eliminates the need to issue any alarm.

The amplifying unit 604 is a device provided to separately amplify individual input signals from the left and right mikes.

The alarm generation unit 605 is a part generating a predetermined alarm signal when it is determined in the comparison-and-analysis unit 602 that a sound matching the registered sound is included in the surrounding sounds. An alarm represented by the alarm signal is any one of a surrounding sound itself including a sound matching the registered sound, the registered sound itself, a certain alarm sound, and a certain warning message, for example. The surrounding sound including the sound matching the registered sound is, for example, an engine sound input from the mike, which is amplified and output. The registered sound itself denotes a previously stored clearer engine sound that is output in place of the engine sound input from the mike. The certain alarm sound denotes a single sound calling the user's attention or the intermittent occurrence of a single sound, a combination of plural single sounds of different pitches, etc. The certain warning message denotes a message prepared by converting certain text such as "vehicle is approaching" into voices. The alarm sound or the warning message may differ in accordance with the type of a registered sound when it is detected that the registered sound matches the surrounding sound.

The combining/switching unit 606 is a part provided to output an alarm signal to the stereo headphones in place of or in addition to the reproduced left and right audio signals.

In the second embodiment, it may be arranged that the balance between the volumes of the left and right surrounding sounds matching the registered sound, which are input from the left and right mikes, is obtained by the comparison-and-analysis unit 602, and the processing performed by the alarm generation unit 605 is controlled, when outputting an alarm, so that the balance is reflected in the volumes of the left and right earphones.

Figure 9:
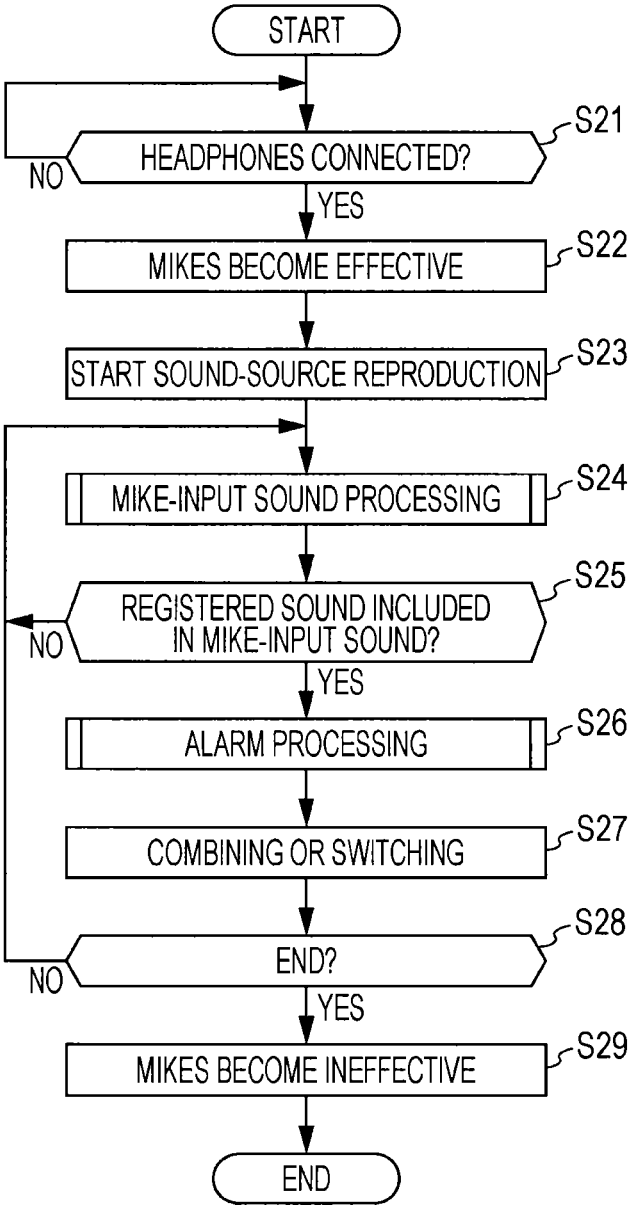
FIG. 9 is a flowchart illustrating a schematic procedure of audio reproducing processing performed in the audio reproducing apparatus of the second embodiment.

FIG. 9 is a flowchart illustrating a schematic procedure of audio reproducing processing performed in the audio reproducing apparatus 600. The processing is achieved when the control unit 101 of the mobile terminal executes a certain application.

First, it is confirmed whether or not the headphones are connected to the audio reproducing apparatus 600 (S21). After confirming that the connection is established, the left and right mikes are made effective (S22). Next, reproduction of the sound source is started (S23).

After that, the collection of surrounding sounds from the left and right mikes is started and certain processing is performed (S24). As stated above, the processing may include amplification and necessary filtering including noise cancellation, etc., and so forth. When performing digital processing, the processing includes analog-to-digital conversion performed for a mike-input signal and post-processing digital-to-analog conversion.

Next, it is determined whether or not a sound matching the registered sound is included in the processed mike-input sounds (surrounding sounds) (S25). When the inclusion is determined, a predetermined alarm signal is generated as certain alarm processing (S26). A specific example of the certain alarm processing will be described later.

A sound (alarm signal) obtained through the alarm processing is output to the stereo headphones in addition to (combining), or in place of (switching) reproduced left and right audio signals (S27).

The processing returns to step S24 and the processing of steps S24 to S27 is repeatedly executed until the end of the processing instruction is issued (S28) in accordance with an instruction from the user or control of the control unit.

After the end instruction is issued, the left and right mikes are made ineffective (S29) and the processing is ended.

Figure 10A:
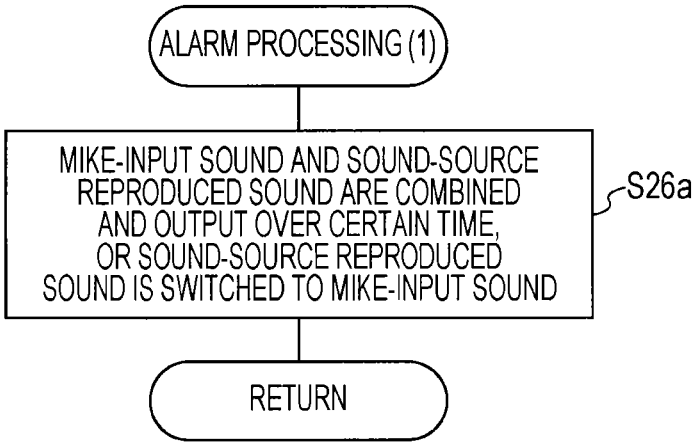
FIGS. 10A and 10B are diagrams illustrating specific examples of alarm processing procedures (1) and (2), respectively, as the processing of step S26 of FIG. 9.
Figure 10B:
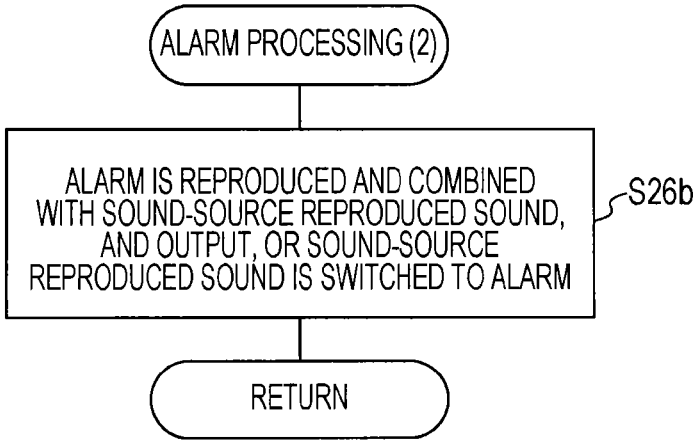

In FIGS. 10A and 10B, specific alarm processing procedures (1) and (2) are respectively illustrated as the alarm processing of step S26 of FIG. 9.

According to the alarm processing procedure (1) of FIG. 10A, a mike-input sound and a sound-source reproduced sound are combined and output over a certain time, or the sound-source reproduced sound is switched to the mike-input sound (S26*a*).

According to the alarm processing procedure (2) of FIG. 10B, an alarm is reproduced and combined with a sound-source reproduced sound, or the sound-source reproduced sound is switched to the alarm (S26*b*).

As an associated operation of the above-stated embodiment, an alarm may be issued from right or left, or both of the earphones when the user wearing the headphones approaches a high-traffic road while walking, for example, by combination with a present-position detection unit (GPS, etc.). The alarm may be a sound or a voice message different from the alarm notifying the approach of the above-stated dangerous object. The high-traffic road may be determined by referring to information that is previously stored in the mobile terminal or registered with a map database accessible via a communication network. The detection of the approach to the high-traffic road may be performed based on the present position and the travel direction of the user (changes in the present position) by referring to the map database.

Figure 11:
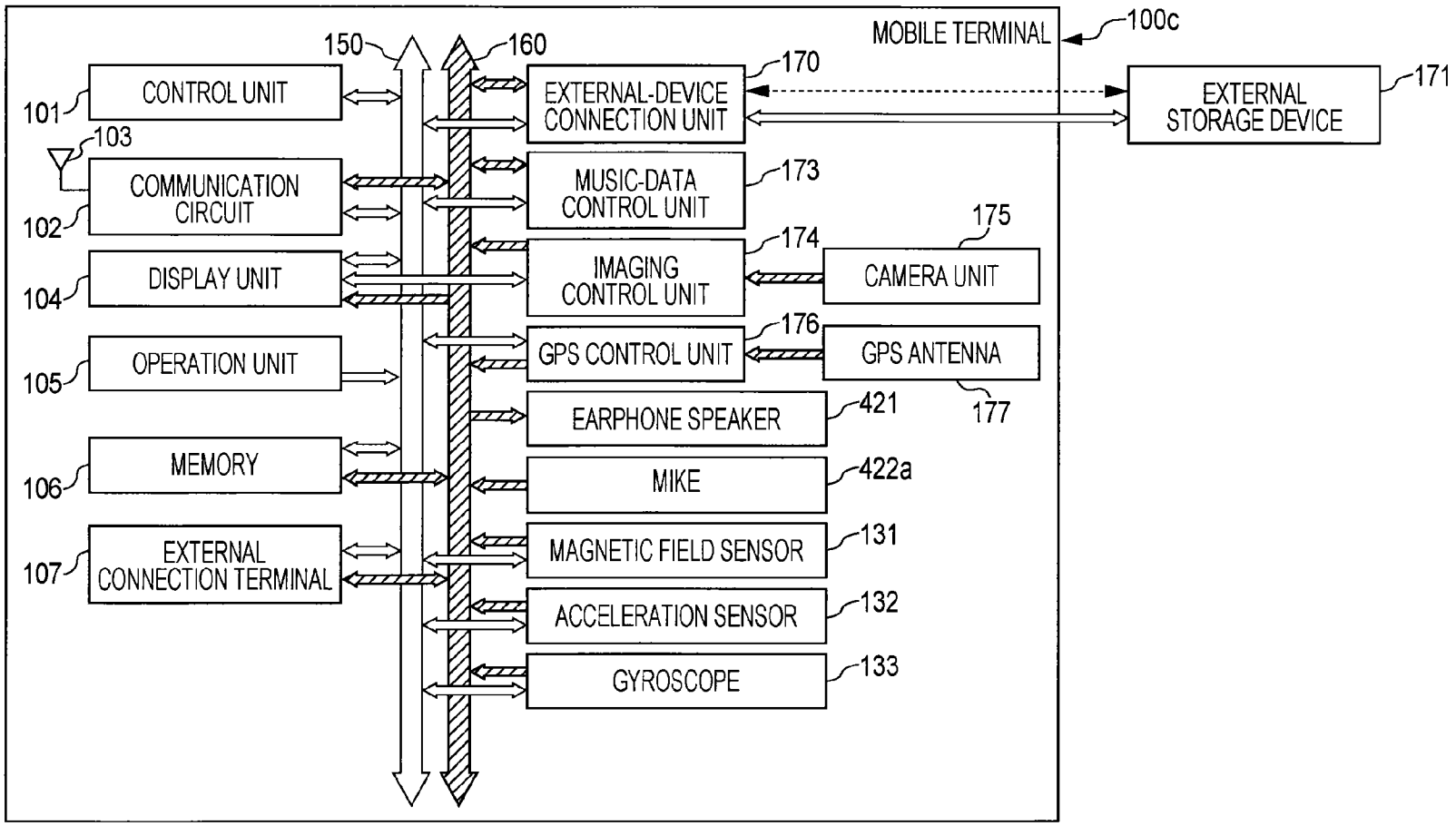
FIG. 11 is a diagram illustrating an exemplary configuration of a headphone (earphone)-integrated mobile terminal.

In the above description, it is assumed that the mobile terminal and the headphones are provided as separate bodies. However, it may be configured that the functions of the mobile terminal are integrated into the headphones. FIG. 11 illustrates an exemplary configuration of such a headphone (earphone)-integrated mobile terminal 100*c*. The device may be considered to be headphones including the mobile-terminal functions.

A speaker 421*a* and a mike 422*a* that are provided for earphones are attached to the cabinet of the mobile terminal 100*c*.

For stereo headphones, each of the left and right earphones may have the configuration of FIG. 11. In that case, the left and right earphones may be controlled so that processing shared between the left and the right is performed with only one of the earphones. Otherwise, the configuration of FIG. 11 is provided only in one of the left and right earphones. In that case, the left and right earphones are connected with a wire or wirelessly connected to each other.

The mobile terminal 100*c* may not necessarily include each of the illustrated elements. Further, the mobile terminal 100*c* may include other components that are not illustrated in FIG. 11 or that are provided in existing mobile terminals.

As described above, embodiments of the present disclosure include the following methods and apparatuses.

(1) An information processing apparatus including: circuitry configured to reproduce left and right audio signals based on data acquired from a sound source; acquire left and right surrounding sounds collected by left and right microphones included in a headphone unit connected to the information processing apparatus; combine a sound corresponding to at least one of the left and right surrounding sounds with at least one of the left and right audio signals; and output the left and right audio signals combined with the sound corresponding to the at least one of the left and right surrounding sounds to left and right earphones of the headphone unit.

(2) The information processing apparatus of (1), wherein the circuitry is configured to: combine the left and right surrounding sounds with the left and right audio sounds; and output the left and right audio signals combined with the left and right surrounding sounds to the left and right earphones of the headphone unit.

(3) The information processing apparatus of any of (1) and (2), wherein the circuitry is configured to: compare the left and right surrounding sounds to a sound registered in advance; and determine whether at least one of the left and right surrounding sounds matches the sound registered in advance.

(4) The information processing apparatus of (3), wherein the circuitry is configured to determine that at least one of the left and right surrounding sounds matches the sound registered in advance only when a volume of the at least one of the left and right surrounding sounds exceeds a predetermined threshold value.

(5) The information processing apparatus of (3), wherein the circuitry is configured to generate, as the sound corresponding to the at least one of the left and right surrounding sounds, an alarm sound when it is determined that the at least one of the left and right surrounding sounds matches the sound registered in advance.

(6) The information processing apparatus of (5), wherein the alarm sound is at least one of a sound corresponding to the registered sound, a predetermined alarm noise and a warning message.

(7) The information processing apparatus of (3), wherein the circuitry is configured to combine the at least one of the left and right surrounding sounds with the at least one of the left and right audio sounds; and output the left and right audio signals combined with the at least one of the left and right surrounding sounds to the left and right earphones of the headphone unit when it is determined that the at least one of the left and right surrounding sounds matches the sound registered in advance.

(8) The information processing apparatus of (1), wherein the circuitry is configured to combine the sound corresponding to the at least one of the left and right surrounding sounds with at least one of the left and right audio signals by replacing the at least one of the left and right audio signals with the sound corresponding to at least one of the left and right surrounding sounds.

(9) A method performed by an information processing apparatus, the method comprising: reproducing left and right audio signals based on data acquired from a sound source; acquiring left and right surrounding sounds collected by left and right microphones included in a headphone unit connected to the information processing apparatus; combining a sound corresponding to at least one of the left and right surrounding sounds with at least one of the left and right audio signals; and outputting the left and right audio signals combined with the sound corresponding to the at least one of the left and right surrounding sounds to left and right earphones of the headphone unit.

(10) A non-transitory computer-readable medium including computer program instructions, which when executed by an information processing apparatus, cause the information processing apparatus to: reproduce left and right audio signals based on data acquired from a sound source; acquire left and right surrounding sounds collected by left and right microphones included in a headphone unit connected to the information processing apparatus; combine a sound corresponding to at least one of the left and right surrounding sounds with at least one of the left and right audio signals; and output the left and right audio signals combined with the sound corresponding to the at least one of the left and right surrounding sounds to left and right earphones of the headphone unit.

Although preferred embodiments of the present disclosure have been described above, different variations and changes other than those described above can be made. That is, it should be understood by those skilled in the art that various modifications, combinations, and other embodiments may occur depending on design and/or other factors insofar as they are within the scope of the claims or the equivalents thereof, as a matter of course.

For example, the adoption or rejection of the processing of the embodiment, which is described with reference to FIG. 9, may be determined based on an application of the mobile terminal. Further, even though the same application is used, the adoption or rejection may be determined in accordance with its operation mode.

A computer program causing a computer to achieve the functions that are described in the above-mentioned embodiments, and a storage medium storing the program in a computer-readable manner are also included in the present disclosure. A "storage medium" provided to supply the program may include, for example, a magnetic storage medium (a flexible disk, a hard disk, a magnetic tape, etc.), an optical disk (a magneto-optical disk including an MO, a PD, etc., a CD, a DVD, and so forth), semiconductor storage, etc.

The invention claimed is:

1. An information processing apparatus comprising:

circuitry configured to:

reproduce left and right audio signals based on data acquired from a sound source;

acquire left and right surrounding sounds collected by left and right microphones included in a headphone unit connected to the information processing apparatus;

combine a sound corresponding to at least one of the left and right surrounding sounds with at least one of the left and right audio signals;

output the left and right audio signals combined with the sound corresponding to the at least one of the left and right surrounding sounds to left and right earphones of the headphone unit;

compare the left and right surrounding sounds with a sound registered in advance;

determine whether at least one of the left and right surrounding sounds matches the sound registered in advance;

compare a volume of the at least one of the left and right surrounding sounds with a predetermined threshold value;

determine whether the volume of the at least one of the left and right surrounding sounds exceeds the predetermined threshold value; and generate an alarm sound only in a case that the circuitry determines the at least one of the left and right surrounding sounds matches the sound registered in advance and the volume of the at least one of the left and right surrounding sounds exceeds the predetermined threshold value.

2. The information processing apparatus of claim 1, wherein the circuitry is configured to:

combine the left and right surrounding sounds with the left and right audio sounds; and output the left and right audio signals combined with the left and right surrounding sounds to the left and right earphones of the headphone unit.

3. The information processing apparatus of claim 1, wherein the circuitry is configured to generate the alarm sound as the sound corresponding to the at least one of the left and right surrounding sounds.

4. The information processing apparatus of claim 3, wherein the alarm sound is at least one of a sound corresponding to the registered sound, a predetermined alarm noise and a warning message.

5. The information processing apparatus of claim 1, wherein the circuitry is configured to:

combine the at least one of the left and right surrounding sounds with the at least one of the left and right audio sounds; and output the left and right audio signals combined with the at least one of the left and right surrounding sounds to the left and right earphones of the headphone unit when it is determined that the at least one of the left and right surrounding sounds matches the sound registered in advance.

6. The information processing apparatus of claim 1, wherein the circuitry is configured to combine the sound corresponding to the at least one of the left and right surrounding sounds with at least one of the left and right audio signals by replacing the at least one of the left and right audio signals with the sound corresponding to at least one of the left and right surrounding sounds.

7. A method performed by an information processing apparatus, the method comprising:

reproducing left and right audio signals based on data acquired from a sound source;

acquiring left and right surrounding sounds collected by left and right microphones included in a headphone unit connected to the information processing apparatus;

combining a sound corresponding to at least one of the left and right surrounding sounds with at least one of the left and right audio signals;

outputting the left and right audio signals combined with the sound corresponding to the at least one of the left and right surrounding sounds to left and right earphones of the headphone unit;

comparing the left and right surrounding sounds with a sound registered in advance;

determining, using circuitry, whether at least one of the left and right surrounding sounds matches the sound registered in advance;

comparing a volume of the at least one of the left and right surrounding sounds with a predetermined threshold value;

determining whether the volume of the at least one of the left and right surrounding sounds exceeds the predetermined threshold value; and generating an alarm sound only in a case that the circuitry determines the at least one of the left and right surrounding sounds matches the sound registered in advance and the volume of the at least one of the left and right surrounding sounds exceeds thepredetermined threshold value.

8. A non-transitory computer-readable medium including computer program instructions, which when executed by an information processing apparatus, cause the information processing apparatus to:

reproduce left and right audio signals based on data acquired from a sound source;

acquire left and right surrounding sounds collected by left and right microphones included in a headphone unit connected to the information processing apparatus;

combine a sound corresponding to at least one of the left and right surrounding sounds with at least one of the left and right audio signals;

output the left and right audio signals combined with the sound corresponding to the at least one of the left and right surrounding sounds to left and right earphones of the headphone unit;

compare the left and right surrounding sounds with a sound registered in advance;

determine whether at least one of the left and right surrounding sounds matches the sound registered in advance;

compare a volume of the at least one of the left and right surrounding sounds with a predetermined threshold value;

determine whether the volume of the at least one of the left and right surrounding sounds exceeds the predetermined threshold value; and generate an alarm sound only in a case that it is determined that the at least one of the left and right surrounding sounds matches the sound registered in advance and the volume of the at least one of the left and right surrounding sounds exceeds the predetermined threshold value.

* * * * *